United States Patent [19]

Potma et al.

[11] 3,967,714

[45] July 6, 1976

[54] MATRIX PRINTER HAVING DETACHABLE ELEMENTS

[75] Inventors: Theodorus Gerhardus Potma; Wilhelmus Adrianus Henricus Gijzen, both of Rijswijk, Netherlands

[73] Assignee: U.S. Philips Corporation, New York, N.Y.

[22] Filed: May 6, 1974

[21] Appl. No.: 467,389

[30] Foreign Application Priority Data

May 30, 1973 Netherlands ..... 7307523

[52] U.S. Cl. ..... 197/1 R; 101/93.05

[51] Int. Cl.² ..... B41J 3/04

[58] Field of Search ..... 197/1 R; 101/93.14, 101/93.04, 93.05, 93.28, 93.29, 93.34; 335/278, 285, 289

[56] References Cited

UNITED STATES PATENTS

| | | | |
|---|---|---|---|
| 2,674,652 | 4/1954 | Johnson et al. | 197/1 R X |
| 3,099,711 | 7/1963 | Foley et al. | 197/1 R |
| 3,656,425 | 4/1972 | Albo et al. | 101/93.14 |
| 3,789,969 | 2/1974 | Howard et al. | 197/1 R |
| 3,797,629 | 3/1974 | Moser | 197/1 R |
| 3,802,543 | 4/1974 | Howard | 197/1 R |
| 3,802,544 | 4/1974 | Howard et al. | 197/1 R |

*Primary Examiner*—Ralph T. Rader
*Attorney, Agent, or Firm*—Frank R. Trifari

[57] ABSTRACT

The invention relates to a matrix printer having a bar-shaped member which is movable along a recording sheet and carries a plurality of straight mutually parallel recording styli which are mounted in a holder and are adapted to be moved perpendicularly to the recording sheet by means of electric energization, and means for moving the recording sheet in a direction transverse to the direction of movement of the bar-shaped member.

6 Claims, 4 Drawing Figures

MATRIX PRINTER HAVING DETACHABLE ELEMENTS

Figure 1:
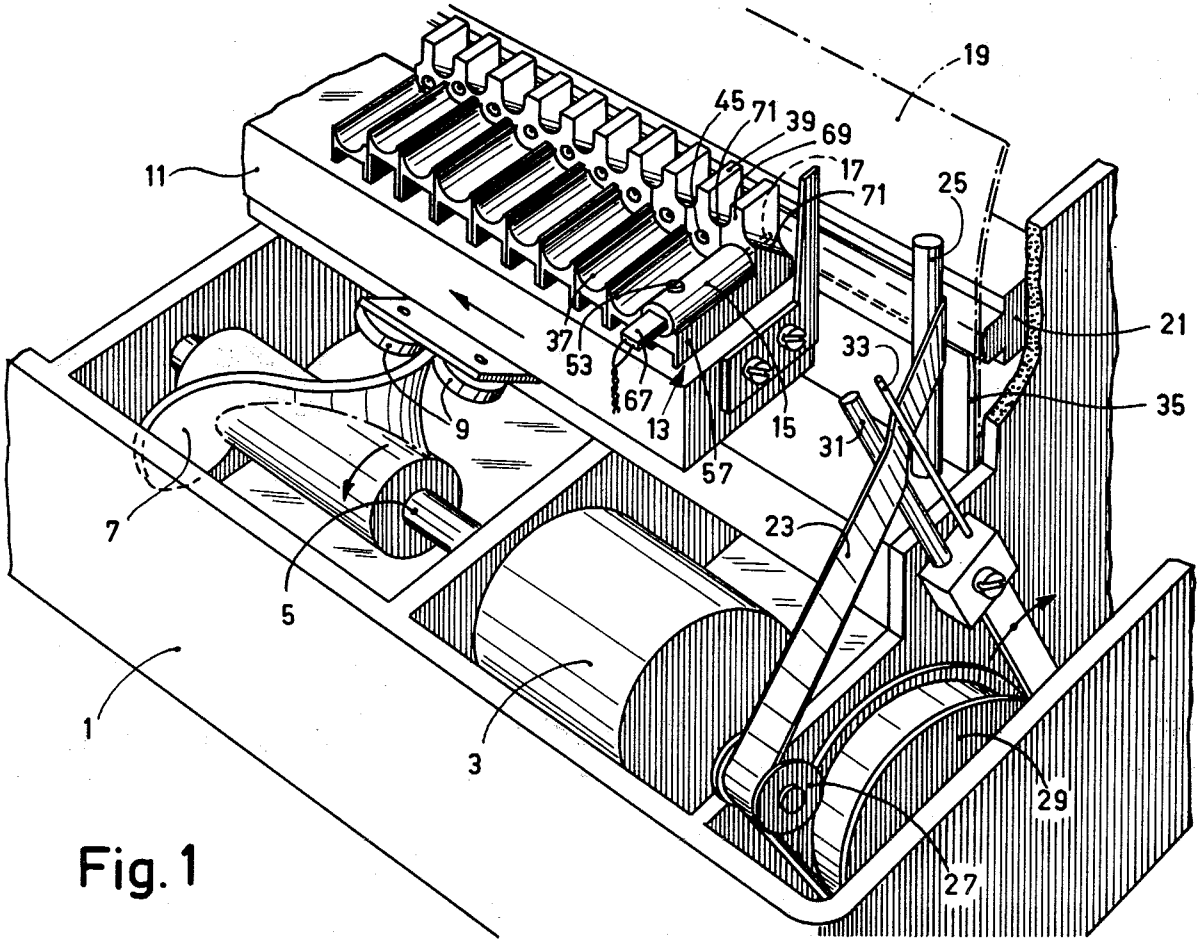

The invention relates to a matrix printer having a bar-shaped member which is movable along a recording sheet and carries a plurality of straight mutually parallel recording styli which are mounted in a holder and are adapted to be moved perpendicularly to the recording sheet by means of electric energization, and means for moving the recording sheet in a direction transverse to the direction of movement of the bar-shaped member.

In a known matrix printer of the type referred to (described in Netherlands Patent Application No. 7,107,209) the bar-shaped member has mounted on it at least one holder which is provided with a plurality of (in the case described nine) recording elements. Such a recording element mainly comprises a casing containing an armature which carries a recording stylus and is movable under spring action by means of an energizing coil. The casing of the recording element is screwed in a bar formed in the holder. The stylus near one end is indirectly guided in the casing by the armature and at the other end is directly guided in a bearing pressed in the holder. The holder is secured to the bar-shaped member by means of bolts.

The aforedescribed known matrix printer has several disadvantages. The first disadvantage is that although the recording element is detachable the bearing must remain in the holder. Hence the recording element cannot separately be tested, which causes great difficulty in maintaining the printer. In particular in printers which use a plurality of holders the tracing of faults and irregularities in the recording element takes much time because it invariably requires the bearing to be removed by means of a special tool and then mounted in the testing device. The second disadvantage of the known matrix printer is a question of manufacturing technology. In what are generally referred to as multiple holders, that is to say holders each containing a plurality of recording elements, the bores for receiving these elements must be accurately spaced. Even small differences in the distances between the centres of the bores have marked adverse affects on the recognizability and legibility of the characters printed, for satisfactory quality of the characters requires exact equality of the spacings between the various dots in the matrix of a printed character. In particular deviations produced in the vertical and horizontal parts of a printed character are inconvenient. In mass production, using conventional tools operated by persons of average skill, the desired degree of accuracy of the bores in the holder is only obtainable at great expense. Dimensional differences further result in loss (rejection) of an expensive holder.

It is an object of the present invention to provide a matrix printer of the type referred to in which the former disadvantage is completely avoided and the latter disadvantage is greatly reduced.

For this purpose a matrix printer according to the invention is characterized in that the bar-shaped member is provided with a plurality of chair-shaped holders which are equally spaced in the direction of length of the member and each are provided with a detachable complete and mainly cylindrical recording element containing a recording stylus and each have a seat by which the recording element is supported along at least two line segments which extend parallel to the direction of length of the styli.

A particular embodiment of a matrix printer according to the invention is further characterized in that the said holder is provided with a cylindrical seat and an adjoining back in which a bearing for that end of the recording element which faces the recording sheet is arranged.

In another particular embodiment of a matrix printer according to the invention the chair-shaped holders are adhesively secured to the bar-shaped member.

Figures 2, 3:
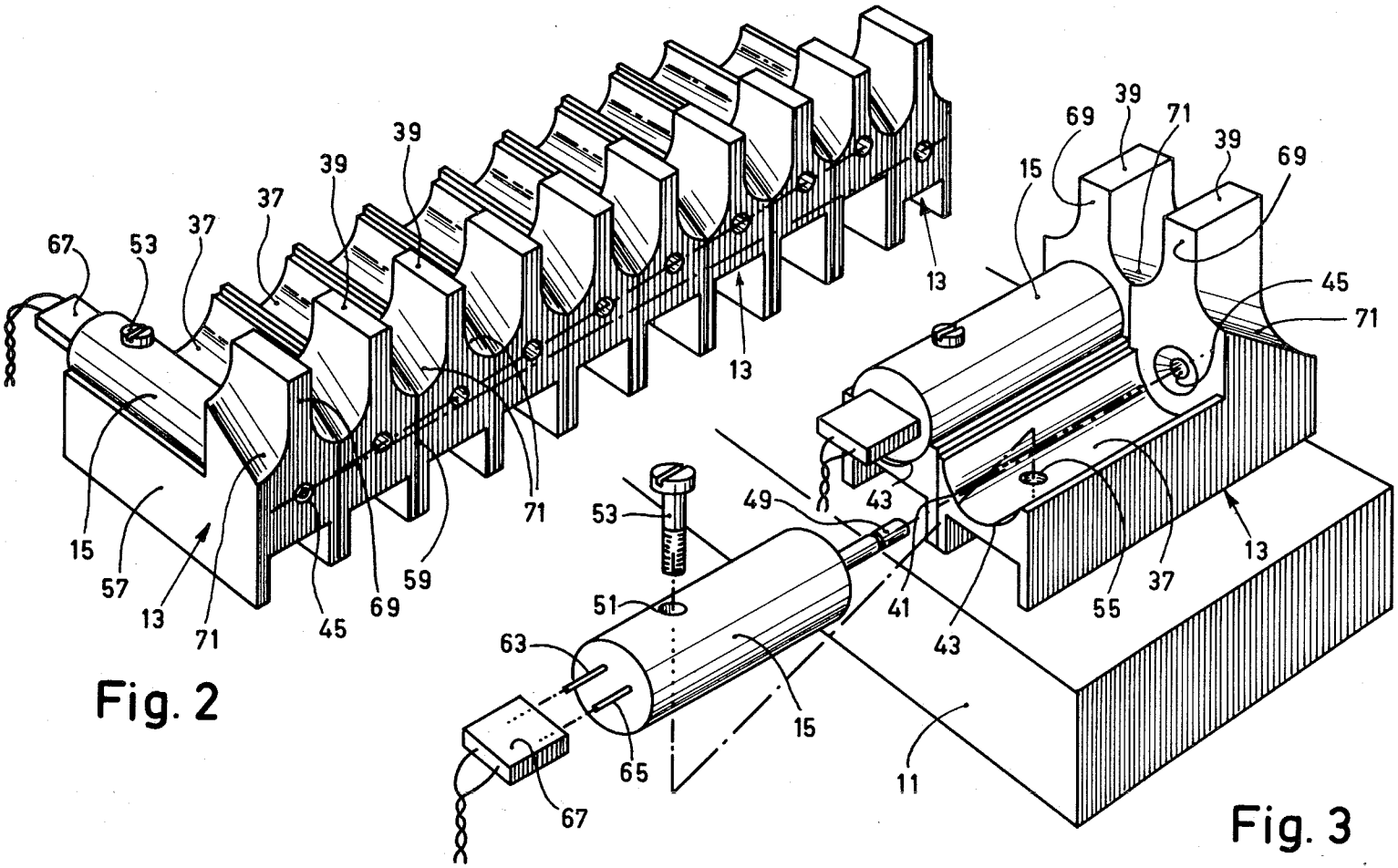
Figure 4:
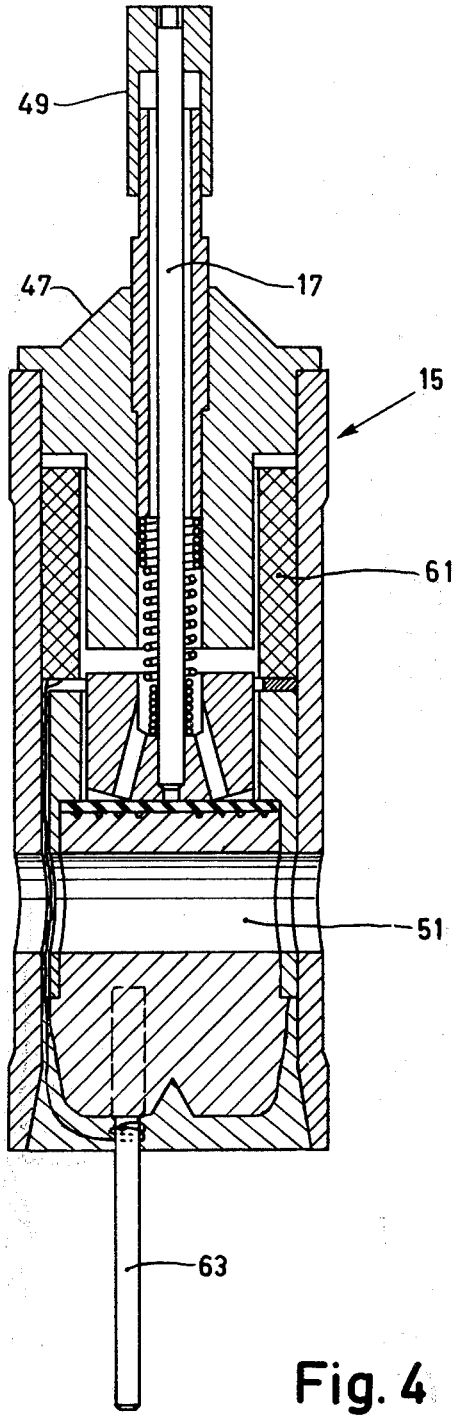

An embodiment of a matrix printer according to the invention will now be described with reference to the accompanying drawing, in which:

FIG. 1 is a perspective view of part of a matrix printer according to the invention, FIG. 2 shows to an enlarged scale a perspective view, taken from the side of the recording sheet, of the chair-shaped seats in a printer as shown in FIG. 1, FIG. 3 is a perspective view taken between two adjacent holders as shown in FIG. 2, and FIG. 4 shows a recording element to be secured to a holder as shown in the preceding Figures.

Referring now to FIG. 1, there is shown a matrix printer which includes an electric motor 3 which is accommodated in a casing 1 and the driving shaft 5 of which is coupled to a helical driving cam 7. By means of two rollers 9 which are secured for rotation to a bar 11 and each engage an edge of the cam 7 a reciprocating horizontal translatory movement of the bar 11 is obtained. To the bar 11 are secured a plurality of holders 13 of equal shape which will be described more fully hereinafter and each carry a recording element 15. In FIG. 1, only one of these recording elements 15 is shown. The recording elements 15 contain electrically energized mutually parallel recording styli 17 which are adapted to be moved in a direction transverse to a recording sheet 19 disposed behind the holders 13 (see also FIG. 4). A displaceable anvil 21 is arranged behind the recording sheet 19. At the printing instants a linked ribbon 23 is interposed between the recording sheet 19 and those ends of the styli 17 which face the recording sheet, which ribbon is guided along the rear surfaces of the holders 13 at the level of the styli 17. On both sides of the printer (only the right-hand side is visible) the ribbon 23 is guided around a fixed pin 25 and via a guide roller 27 to a reel 29. In its travel between the pin 25 and the guide roller 27 the ribbon 23 is guided between two pins 31 and 33 which for reasons to be set out hereinafter can jointly be pivoted in a plane which is perpendicular to the direction of movement of the bar 11. The position of the pins 31 and 33 shown in FIG. 1 is the position at the instant at which the styli 17 impinge on the recording sheet 19. Between the recording sheet 19 and the ribbons 23 there is interposed a fixed plate 35 having a beveled upper end which prevents the recording sheet and the ribbon from coming into contact with one another before the printing instant. Otherwise ink smudges might be produced on the recording sheet, which hereinafter will be referred to as paper. The plate 35 also serves as a stop for the anvil 21. Each time a line has been printed the anvil 21 is briefly retracted to enable the paper to be fed forward. The paper feed means are of a conventional type and hence are not shown for simplicity. The paper 19 is intermittently moved in a direction at right angles to the direction of movement of the bar 11. As has been stated hereinbefore, the ribbon 23 is in the position shown at the printing instant. In this position part of the width of the ribbon 23 obviously will lie above the plate 25. The styli 17 lie at a level slightly above the upper edge of the plate 35.

The bar 11 of the printer shown in FIG. 1 carries six sets of nine individual holders 13 each. In each set the distances between the centres of the styli 17 are equal. A holder 13 substantially comprises a chair-like device consisting of a cradle-shaped part (seat) or cradle 37 and an adjoining back-shaped part or back 39. The cradle 37 roughly has the form of a cylinder which is slightly recessed so that the recording element 15 of circular cylindrical shape supported in the cradle has two line segments 41 and 43 (see FIG. 3), which are parallel to one another and to the stylus 17, in common with the cradle. The back 39 of each holder 13 is formed with a bore 45 which is conical at the end more remote from the paper 19 and circular-cylindrical at the end near the paper 19. The axis of the bore 45 coincides with the axis of the stylus 17. The recording element 15, which is shown in detail in FIG. 4, has a conical part 47 and a circular-cylindrical part 49. The conical part 47 is supported in the conical part of the bore 45, and the circular-cylindrical part 49 is supported in the circular-cylindrical part of the bore 45 (see also FIG. 2). At the end more remote from the paper 19 the recording element 15 is formed with a cylindrical bore 51. By means of a bolt 53 passed through the bore 51 the recording element 15 is detachably secured in the cradel 37. For this purpose the cradle 37 has an internally threaded bore 55.

All the recording elements 15 are equal in shape and in size. This is not the case with the holders 13 of any one set. The holders 13 in a set are identical in shape but different in several dimensions. This dimensional difference is directly related to the manner in which a character is printed by the printer shown. Each stylus 17 in a set is used for printing dots of the matrix which always are at the same level in the character to be printed. In the printer under consideration nine levels are printed, each by an associated stylus. The matrix used in the preferred embodiment is nine by nine. Consequently the line which joins the corresponding ends of styli of any one set is at an angle to the direction of the line being printed (see also FIG. 2). The total height, the width and the length of the holders are equal in all six sets, as are the dimensions of the cradles 37 and the backs 39. However, the height in the holder-reckoned from the bearing surface of the holder 13 on the bar 11 — at which the cradel 37 and the bore 45 are located is different for each stylus in any one set.

The six sets of nine holders each are equal to one another. The corresponding holders in the various sets also are equal to one another. It will be clear that when more than six sets of holders are disposed on the bar 11 but the width of the line to be printed remains the same the stroke of the bar will be less than in the case of six sets. The holders 13 may alternately be arranged on the bar 11 so as to be spaced from one another. However, this increases the stroke of the bar 11, which causes the size of the printer to be increased.

In the preferred embodiment of a printer shown in FIG. 1 each holder 13 has two lateral or fitting surfaces 57 and 59 which extend parallel to one another and to the stylus 17 (see also FIG. 2) and at right angles to the direction of length of the bar 11. A lateral surface 57 always engages a lateral face 59 of the adjacent holder.

The holders 13 are preferably made of aluminium by pressure-diecasting. They may however be made of other metals. The free ends of the styli 17 must be spaced accurately and equally from the information carrier 19. Hence not only the dimensional accuracies of the holders 13, the styli 1 and the bar 11 but also the locations of the individual holders on the bar 11 are of importance. This applies in particular to the location in the direction of movement of the styli. In the preferred embodiment of the printer shown in FIG. 1 differences and inaccuracies in the relative positioning of the holders on the bar are prevented by securing the holders 13 to the bar 11 by means of an adhesive, for example, an epoxy resin adhesive. Adhesive securing of the holders 13 to the bar 11 provides the great advantage that a highly accurately manufactured jig can be used. This jig is provided with accurately spaced dowels which engage in the bores 45 of the holders 13, but may also be provided with accurate securing means for the holders. The holders to be located are accurately secured to the jig which then is correctly positioned with respect to the bar 11, which has previously been provided with an adhesive layer. The jig is removed only after a reliable mechanical bond has been produced between the holders and the bar, i.e. after the adhesive layer has sufficiently hardened or dried. Making the dowels or other securing means of the jig adjustable in the direction of the styli enables compensation for discrepancies in this direction both of holders 13 and of recording elements 15. The jig also offers a satisfactory possibility of checking the correctness of the dimensions of holders and recording elements. Defective holders which even after adjustment in the jig do not allow correct positioning can immediately be detected and removed. Thus only a comparatively cheap component is wasted.

It will also be clear from the above why the individual holders each containing a complete recording element offer advantages over the known multiple holders each containing more than one recording element. When a multiple holder is incorrectly dimensioned the entire expensive holder is to be regarded as waste. There is no possibility of correcting incorrectly spaced bores for receiving the recording elements. In addition, a multiple holder must in principle satisfy even more stringent requirements of dimensional accuracy than a single holder, which moreover is adjustable to a certain extent. In mass production a multiple holder is more likely to be rejected than an individual holder, because in the latter a considerable part of the requirements of dimensional accuracy can be satisfied owing to the fact that only a single highly accurate jig, or at most a comparatively small number of such jigs, is manufactured. The jig may be made by a few highly specialized skilled persons. The manufacturing of the multiple holders would greatly increase the cost of the printer since each multiple holder must be made by highly specialized persons.

Finally a further considerable advantage of the individual holder containing detachable complete recording elements over the multiple holder should be mentioned. When during operation of a printer a fault occurs or the quality of the printing deteriorates, it often is desirable for the recording elements to be individually tested. Because in a multiple holder the front bearing of the stylus is pressed in the holder, individual testing is either not possible or hardly possible. In a printer according to the invention the complete recording element (see FIG. 4) can simply and rapidly be detached by removing the respective bolt 53 (see FIGS. 1 and 3). The circular-cylindrical part 49 (see FIG. 4 constituting the front bearing for the stylus 17 remains integral with the recording element, permitting the latter to be individually tested. To simplify testing each recording element 15 (see FIGS. 3 and 4) is provided with two contact pins 63 and 65 connected to an energizing coil 61 which in the operation of the printer form a plug for insertion into a socket 67 and which for testing can be inserted into an identical socket of the testing device.

In the particular embodiment of a printer according to the invention shown in FIGS. 1, 2 and 3 the back 39 of each holder 13 has a narrow part 69. In addition, each back 39 on either side of the narrow part has a bevel 71 which is inclined towards the respective stylus and fittingly joins the facing bevel of an adjacent holder. The narrow part 69 together with the bevels 71 enables the operator of the printer to see the paper through the holders in operation. The frequency of the reciprocating bar is so high that a clear image of each character is obtained substantially immediately after it has been printed. This is of high importance for fault detection, permitting rapid action to stop the printer. In view of this direct visibility, in the printer shown in FIG. 1 a special provision has been made with respect to the linked ribbon 23. By turning the pins 31 and 33 in the direction of the arrow the ribbon may be lowered to a level lower than the line being printed. The logic of the printer is such that this turning movement of the pins 31 and 33 is started a given very short time after the latest coil energization of a recording element. The pins 31 and 33 are returned to the initial positions shortly before new energizing ppulses are applied. The printer further permits the ribbon 23 to be lowered and raised by hand at any desired instant. In printers according to the invention which use what is termed pressure-sensitive paper the ink ribbon and the associated mechanism can obviously be dispensed with.

The invention described has been illustrated with reference to a printer in which the free ends of the styli lie on a line at an angle to the printing line direction. However, the invention is not restricted thereto. The free ends of the styli may well be made to lie on a line parallel to the printing-line direction. In this case each stylus prints all the dots in every one of the nine levels in the matrix of a character, i.e. at least one complete character. The number of characters depends upon the spacing between two adjacent styli. The stroke of the bar is matched to this spacing. In this case the paper is fed forward, for example, intermittently through distances equal to the vertical distance between two dots in the matrix of characters to be printed. Thus all the holders are equal in shape and in size.

Furthermore the invention is not restricted to the embodiment shown with abutting holders. If a slightly increased size of the printer is not objectionable, the holders may be spaced from one another. Obviously the stroke of the bar will then be correspondingly increased. An advantage is, however, that the lateral faces 57 and 59 of the holders no longer need to satisfy exacting requirements of dimensional accuracy.

The cradle 37 of the holder also need not necessarily have a recessed cylindrical shape. A circular-cylindrical shape and a right cylindrical shape may also be used. The recording element 13 may also engage the cradle 37 with parts of its generator. It is even possible to use a holder of U-shaped section with unequal limbs, a V-bearing being formed in the shorter limb and a circular bore for receiving the end of the recording element which faces the paper being formed in the longer limb. The recording element also may have a right cylindrical shape which may or may not be combined with a right cylindrical cradle of the holder.

What is claimed is:

1. A matrix printer for cooperation with an associated recording sheet which comprises: an elongated bar-shaped member; means for moving said member across the associated recording sheet; a plurality of holders carried by said member; a plurality of straight mutually parallel recording stylus assemblies each being carried by one of said holders and each including one stylus, each stylus being elongated and disposed in a common plane with the axis thereof at the same predetermined distance from each adjacent stylus, each stylus assembly including means for moving each stylus perpendicular to the recording sheet responsive to electric energization; and means for moving the recording sheet in a direction transverse to the direction of movement of said bar-shaped member; each of said holders comprising a seat and a back surface disposed in orthogonal relationship; each stylus assembly being detachable and having a substantially cylindrical housing; each of said holder seats having an arcuate surface having a cross-section in a plane normal to the axis of the styli which is arcuate; and each of said stylus assemblies including a bearing for support of said stylus at the end of said stylus which is closest to the recording sheet, each of said back surfaces being dimensioned and configured for engagement with the exterior of said bearing of the stylus assembly carried by any one of said holders, said back surface limiting axial movement of the stylus assembly disposed therein toward the associated recording sheet.

2. A matrix printer as claimed in claim 1, wherein said holders are adhesively secured to said bar-shaped member.

3. A matrix printer as claimed in claim 2, wherein each of said recording elements is secured to the associated holder by means of a bolt passing through said element.

4. A matrix printer as claimed in claim 3, wherein each holder has two mutually parallel lateral surfaces by which it engages an adjacent holder.

5. A matrix printer as claimed in claim 4, wherein the back surface of each holder has upstanding lateral surfaces which abut adjacent holders.

6. A matrix printer as claimed in claim 5, wherein the back surface of each holder is bevelled intermediate said upstanding lateral surfaces.

* * * * *

UNITED STATES PATENT AND TRADEMARK OFFICE

CERTIFICATE OF CORRECTION

PATENT NO. : 3967714
DATED : July 6, 1976
INVENTOR(S) : Theodorus G. Potma et al It is certified that error appears in the above–identified patent and that said Letters Patent are hereby corrected as shown below:

Column 3, line 31
"cradel" should be --cradle--

Column 3, line 51
"cradel" should be --cradle--

Column 5, line 34
"ppules" should be --pulses--

Signed and Sealed this

Eleventh Day of January 1977

[SEAL]

*Attest:*

RUTH C. MASON
*Attesting Officer*

C. MARSHALL DANN
*Commissioner of Patents and Trademarks*